US006354573B1

(12) United States Patent
Morando

(10) Patent No.: US 6,354,573 B1
(45) Date of Patent: Mar. 12, 2002

(54) SWIMMING POOL HIGH VELOCITY HEATING SYSTEM

(76) Inventor: Jorge A. Morando, 526 Riverview Trail, Cadiz, KY (US) 42211

( * ) Notice: Subject to any disclaimer, the term of this patent is extended or adjusted under 35 U.S.C. 154(b) by 0 days.

(21) Appl. No.: 09/668,062

(22) Filed: Sep. 25, 2000

(51) Int. Cl.[7] ..... B01F 3/04

(52) U.S. Cl. ..... 261/128; 261/29; 261/35; 261/77; 261/121.1; 261/131; 261/141; 4/493

(58) Field of Search ..... 261/29, 35, 36.1, 261/77, 128, 130, 131, 141, 121.1; 4/493

(56) References Cited

U.S. PATENT DOCUMENTS

| | | | | | |
|---|---|---|---|---|---|
| 520,342 | A | * | 5/1894 | Sutro | 4/493 |
| 1,982,258 | A | * | 11/1934 | Martin | 261/77 |
| 2,055,211 | A | * | 9/1936 | Yoder | 261/77 |
| 2,135,043 | A | * | 11/1938 | Seman | 261/77 |
| 2,297,768 | A | * | 10/1942 | Hutchings | 261/77 |
| 3,095,463 | A | * | 6/1963 | Chang et al. | 261/130 |
| 3,756,220 | A | * | 9/1973 | Tehrani et al. | 4/493 |
| 4,189,791 | A | * | 2/1980 | Dundas | 4/493 |
| 5,605,653 | A | * | 2/1997 | Devos | 261/77 |
| 5,863,314 | A | * | 1/1999 | Morando | 75/708 |
| 6,039,917 | A | * | 3/2000 | Morando | 266/217 |
| 6,103,123 | A | * | 8/2000 | Gantzer | 261/35 |

FOREIGN PATENT DOCUMENTS

| | | | | | |
|---|---|---|---|---|---|
| DE | 201014 | A | * | 3/1907 | 261/77 |

* cited by examiner

*Primary Examiner*—C. Scott Bushey
(74) *Attorney, Agent, or Firm*—Charles W. Chandler

(57) ABSTRACT

A jet reactor pump as used to circulate heated water into a swimming pool at near sonic velocity to heat the swimming pool water.

6 Claims, 2 Drawing Sheets

SWIMMING POOL HIGH VELOCITY HEATING SYSTEM

BACKGROUND AND SUMMARY OF THE INVENTION

Swimming pools are conventionally heated by introducing hot water (110° to 120° F.) into the pool at a velocity not exceeding 12 ft/sec to avoid large pressure losses. The heating system (very much like a water heater) heats a copper coil inside which the water travels, wasting 80 to 90% of the heat. Enormous losses occur when trying to heat a standard swimming pool of 22 ft.×15 ft×5 ft with 12,000 gal of water. During the heating process, heat is lost by evaporation from the pool surface to the environment at a rate proportional to the difference in temperature between the pool water and the atmosphere. The slower the water is heated, the greater the heat loss.

Heat transfer velocity is a function of $$\frac{dE}{dt} = f(\Delta V^2, \phi, \Delta T)$$

$\Delta V^2$=Relative Velocity of the two elements $\phi$=Flow rate of Heating Media $\Delta T$=Difference in temperature of the two elements If superheated gas is introduced into the water at a very high velocity using a jet reactor pump, maximum heat transfer per unit time is possible since:

a) The gas can be introduced at a near sonic velocity (several orders of magnitude over 12 ft/sec)

b) Gas (air) can be heated to any temperature without the concern of vapor locking the system (for fabrication simplicity and safety, I recommend approximately 360° F. to 400° F.).

c) The gas/liquid flow efficiency of a jet reactor pump is well above 50% (volume to volume) which is several times a liquid/liquid pump. A liquid/liquid pump could be used, except that it has a maximum temperature limitation that gas/liquid does not.

d) A 4" diameter pipe jet reactor pump could circulate all the water in a 12,000-gallon pool in two hours or less vs. 12 to 24 hours for present hot water systems.

e) The losses of heating the water pipe (convection—conduction), to heat the water (convection) and to inject in the pool water (conduction) is eliminated by simply heating the air inserted in the jet reactor that pumps the water as it is being heated.

f) As the water heats up, $\Delta T$ diminishes, reducing the heat transfer velocity (in the present systems)

$T_{water}$≈12020 $T_{start\ pool}$≈50° F. $T_{finish\ pool}$=70° F.

$\Delta T_{start}$=120−50=70° F.

$\Delta T_{finish}$=120−70=50° F.

with gas @ 360° F.

$\Delta T_{start}$=360−50=310° F.

$\Delta T_{finish}$=360−70=290° F.

This shows almost five times better temperature differential transfer rate at the start of heating, and almost six times better differential at the end of the cycle.

Preferably a compressor is used that is capable of delivering 50 to 75 ft$^3$/min. of air @ 50 to 60 psig of pressure (this pressure assures gas sonic velocity in the jet reactor nozzles). Before inserting the air in the jet pump, a heater increases the air temperature to 360° F. to 400° F. The higher the gas temperature, the higher the thermodynamic efficiency of the heating cycle. The gas volume expansion at constant pressure will be:

$$\frac{V_2}{V_1} = \frac{T_2}{T_1} T_2 \text{ and } T_1 = \text{Absolute temperature}$$

$$\frac{50\ \text{ft}^3/\text{min} \times 860}{520} \cong \frac{83\ \text{ft}^3}{\text{min}}$$

This represents a water flow of approximately 42 ft$^3/_{min}$ of water from the jet reactor pump or over 300$^{gal}/_{min}$ which would allow the recirculation of a 12,000 gal pool in less than 40 minutes, unheard of in any water heater/water pump system.

DESCRIPTION OF THE DRAWINGS

The description refers to the accompanying drawings in which.

DESCRIPTION OF THE PREFERRED EMBODIMENT

Figure 1:
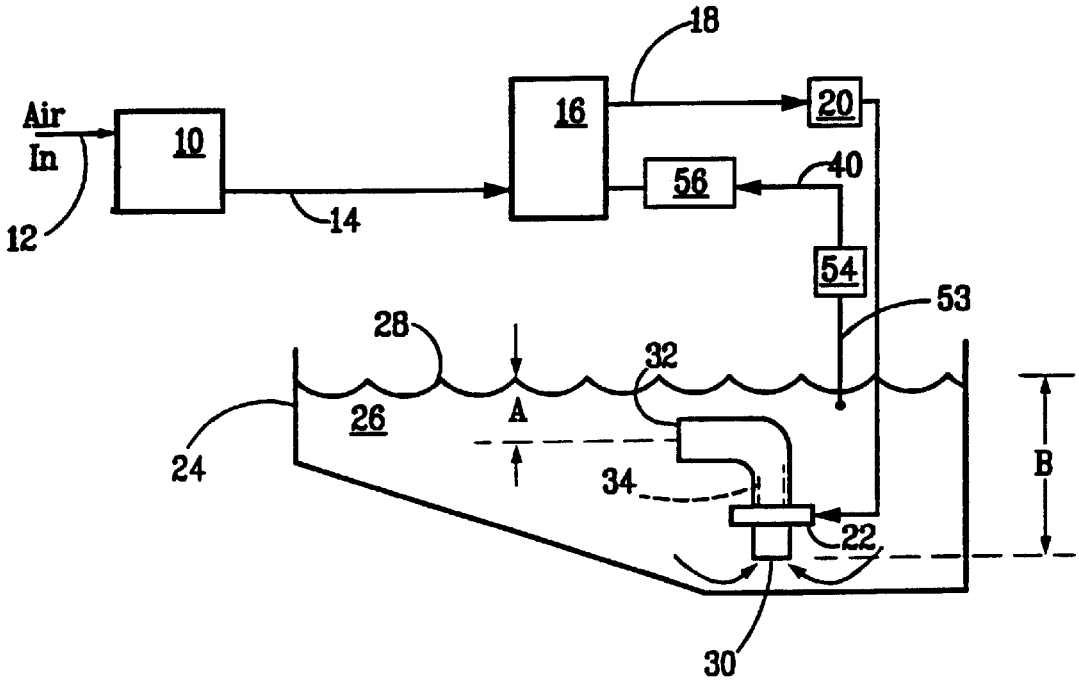
FIG. 1 is a schematic diagram, including a temperature feedback control system for reducing the heater operating temperature as the water in the pool reaches the desired temperature. The system will then maintain the desired temperature, only making up for the convection losses to the atmosphere.

Referring to the drawings, a compressor 10 compresses air received from a suitable source through a conduit 12 at 50 ft$^3$/min at 50 psig. The compressed air then passes through a conduit 14 to a heater 16 at a rate of 80 c.f.m., which may be either electric or gas. The heater raises the temperature of the compressed gas to about 400° F. The heated gas passes through a conduit means 18 to a gas relief valve 20 and then to the intake of a jet reactor pump 22. Pump 22 is disposed, for illustrative purposes, in a swimming pool 24, which contains a body of water 26 having a water level 28. Preferably, pump 22 has an inlet opening 30 that is three to six feet below water level 28, a depth of "B". The pump has an outlet opening 32 for discharging the mixture of water and air, preferably located a depth "A" about 1–3 feet below the water surface.

The general principles of such a jet reactor pump are described in my U.S. Pat. No. 6,039,917, issued Mar. 21, 2000 for "Jet Column Reactor Pump with Coaxial and/or Lateral Intake Opening".

Figure 2:
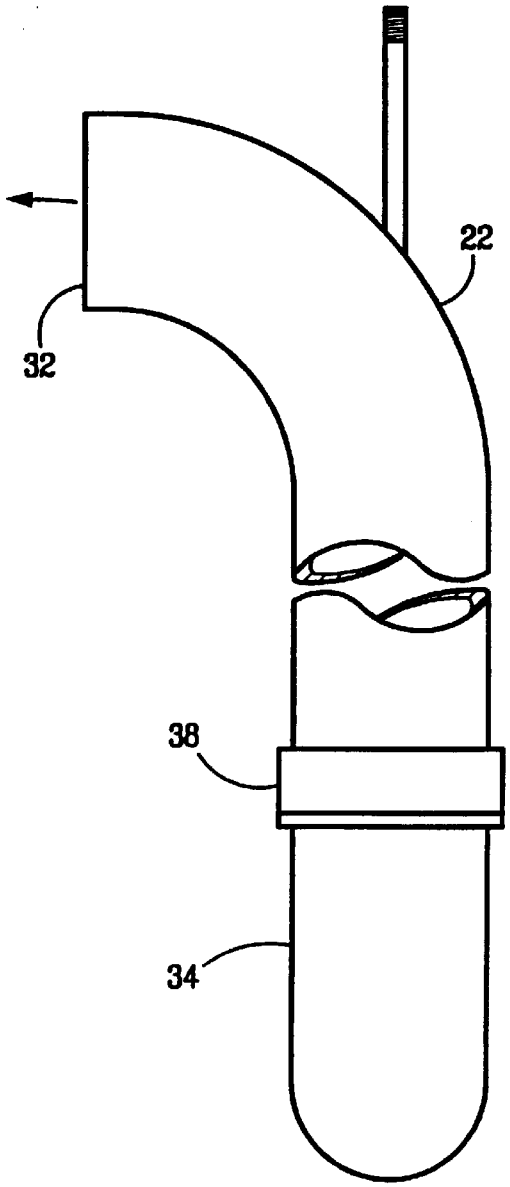
FIG. 2 is an enlarged elevational view of an illustrative pump.
Figure 3:
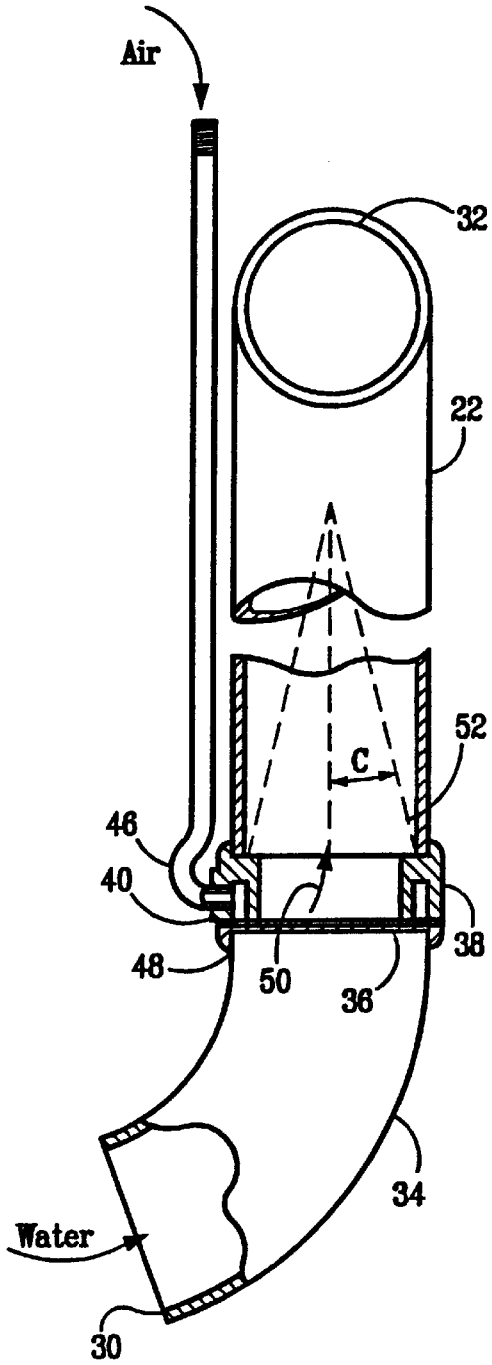
FIG. 3 is a sectional view of the preferred pump.

FIGS. 2 and 3 illustrate a pump useful for pumping and simultaneously introducing air into the body of water 26. Pump 22 has a cylindrical inlet conduit 34, a thin annular jet pump cover 36, and an annular pump body 38.

Cover 36 is mounted between the upper end of conduit 34 and pump body 38, as viewed in FIG. 3. Pump body 38 is welded to cover 36, and has an inlet opening 40 for receiving an air-receiving conduit 46. Inlet opening 40 is connected to an annular passage 48 that extends around the path of motion of the water generally shown in the direction of arrow 50. Conduit 46 delivers air from compressor 10. The pump materials may be of any suitable material that is compatible with the swimming pool water.

The jet pump body has three annularly spaced jet openings 52, connected to passage 48 to the downstream face of the pump body. Openings 52 are disposed at an angle "C" of about 7.5° with respect to water motion 50, to deliver the air in a conical path at sonic or near sonic velocity (whichever is best suited to the application) into the water flow. This arrangement transfers the air momentum to the water thereby increasing the pump efficiency. The compressed air is introduced into the water and expands to create a flow from inlet opening 30 to outlet opening 32 which in turn circulates the water in swimming pool 24.

Assuming the pool water temperature at the start of the heating cycle is at temperature $T_1$ of 50° F., and it is desired to increase the temperature of the water to a temperature of $T_2$ of 70° F. The pump circulates the water in the pool while at the same time heating the pool water with the heated air.

A sensing conduit 53 measures the water temperature and feeds back a signal to water temperature feedback valve 54 that controls the temperature output of the heater temperature controller 56. The heater temperature controller adjusts the heat output of heater 16 to a rate that accommodates the difference between the actual temperature of the water and the desired temperature.

The pool can be heated very quickly in 1–2 hours vs. 48–64 hours using present heating systems. After the pool is heated, the system is automatically reset for holding the injected air at 140°–160° F. in a sonic velocity transfer process to maintain the pre-selected temperature.

Preferably, no one is permitted to swim in the pool during the accelerated heating, for safety reasons. It is believed that the system using a low gas (air) flow and inexpensive equipment and operation costs will cost about 10%–15% of currently available commercial systems.

What is claimed is:

1. A method for heating a body of a liquid from a first lower temperature $T_1$, to a second higher temperature $T_2$, comprising the steps of:

compressing a gas;

heating the compressed gas to a third temperature $T_3$, higher than a second higher temperature $T_2$;

introducing the compressed heated gas into an elongated heating conduit disposed in a body of a liquid having a lower temperature $T_1$ such that the gas expands to induce a flow of the liquid in the heating conduit and raises the temperature of the flowing liquid in the heating conduit to a temperature greater than said second temperature $T_2$, and then delivering the heated flowing liquid from the heating conduit into the body of the liquid to raise the temperature thereof toward temperature $T_2$ at a heat transfer rate that is in accordance with the velocity of the heated liquid flowing from the heating conduit into the body of the liquid.

2. A method as defined in claim 1, including the step of using a jet reactor pump to circulate the liquid in the body of liquid.

3. A method as defined in claim 1, including the step of heating and compressing air.

4. Apparatus for heating and circulating a liquid in a container having an initial temperature $T_1$, comprising:

an elongated heating conduit having a liquid inlet opening disposed beneath the surface of a liquid in a container of the liquid, the liquid having a lower temperature $T_1$;

the heating conduit having a liquid outlet opening for discharging liquid received in the inlet opening along a path of motion, to a location beneath the surface of the liquid in the container;

means for compressing a gas;

means for heating the compressed gas to a temperature $T_3$, which is greater than the temperature $T_1$ of the liquid in the container;

a plurality of gas-discharge nozzles in the heating conduit disposed around the path of motion of the liquid flowing through the elongated heating conduit;

a gas delivery conduit connected to the heating conduit for delivering heated, compressed gas to the gas-discharge nozzles such that the heated gas induces a flow of liquid from the inlet opening to the outlet opening of the heating conduit and heats the induced liquid flowing through the heating conduit to a temperature greater than temperature $T_1$; and the outlet opening of the elongated conduit being disposed to introduce the heated liquid flowing from the conduit into the body of liquid to heat the body of liquid to temperature $T_2$ at a heat transfer rate that is in accordance with the velocity of the heated liquid flowing from the outlet opening of the heating conduit into the body of the liquid.

5. Apparatus as defined in claim 4, including a temperature feedback valve means for measuring the internal water temperature in the pool of water, and means connecting the feedback valve means to the heating means for controlling the heat input into the compressed air that accommodates the difference between the internal water temperature $T_1$ and a desired water temperature $T_2$.

6. Apparatus as defined in claim 5, in which the feedback valve is operative to signal the heating means to heat the water at an accelerated rate when the difference between $T_1$ and $T_2$ is greater than a desired $\Delta T$, and at a standby rate when the temperature difference is relatively stable.

* * * * *